US005117865A

United States Patent [19]

Lee

[11] Patent Number: 5,117,865

[45] Date of Patent: Jun. 2, 1992

[54] PAPERMAKERS FABRIC WITH FLAT HIGH ASPECT RATIO YARNS

[75] Inventor: Henry J. Lee, Summeville, S.C.

[73] Assignee: Asten Group, Inc., Charleston, S.C.

[21] Appl. No.: 654,008

[22] Filed: Feb. 14, 1991

Related U.S. Application Data

[63] Continuation-in-part of Ser. No. 534,164, Jun. 6, 1990.

[51] Int. Cl.[5] ..... D03D 23/00

[52] U.S. Cl. ..... 139/383 A; 162/DIG. 1; 428/225; 428/229

[58] Field of Search ..... 139/383 A; 162/DIG. 1, 162/348; 428/225, 229

[56] References Cited

U.S. PATENT DOCUMENTS

| | | | |
|---|---|---|---|
| 1,050,406 | 1/1913 | Veit . | |
| 2,854,032 | 8/1953 | Santos | 139/411 |
| 4,026,331 | 5/1977 | Lees et al. | 139/383 A |
| 4,142,557 | 3/1979 | Kositzke | 139/425 A |
| 4,290,209 | 9/1981 | Buchanan et al. | 34/123 |
| 4,351,874 | 9/1982 | Kirby | 428/229 |
| 4,356,225 | 10/1982 | Dufour | 428/234 |
| 4,438,788 | 3/1984 | Harwood | 139/383 A |
| 4,438,789 | 3/1984 | MacBean | 139/383 A |
| 4,461,803 | 7/1984 | Booth et al. | 428/234 |
| 4,469,142 | 9/1984 | Harwood | 139/383 A |
| 4,537,816 | 8/1985 | Booth et al. | 428/234 |
| 4,621,663 | 11/1986 | Malmendier | 139/383 A |
| 4,755,420 | 7/1988 | Baker et al. | 428/222 |
| 4,815,499 | 3/1989 | Johnson | 139/383 A |
| 4,824,525 | 4/1989 | Penven | 162/358 |
| 4,846,231 | 7/1989 | Penven | 139/383 A |
| 4,883,096 | 11/1989 | Penven | 139/383 A |
| 5,066,532 | 11/1991 | Gaisser | 428/137 |

*Primary Examiner*—James J. Bell

*Attorney, Agent, or Firm*—Volpe and Koenig

[57] ABSTRACT

The present invention is directed to a papermakers fabric which provides for usage of high aspect ratio yarns as structured weave components. The fabric comprises a system of flat monofilament machine direction yarns (hereinafter MD yarns) which are woven in a selected weave construction which provides stability to the fabric. In a preferred embodiment, the system of MD yarns comprises upper and lower yarns which are vertically stacked. Preferably, the upper MD yarns define floats on the upper surface of the fabric and each upper MD yarn is paired in a vertically stacked orientation with a lower MD yarn. The lower MD yarns may weave in an inverted image of the upper MD yarns to provide floats on the bottom fabric surface or may weave with a different repeat to provide a different surface on the bottom of the fabric.

At least the upper MD yarns are flat monofilament yarns woven contiguous with each other to reduce the permeability of the fabric and to lock in the machine direction alignment of the stacking pairs of MD yarns. In the preferred embodiment, the same type and size yarns are used throughout the machine direction yarn system and both the top and the bottom MD yarns weave contiguously with adjacent top and bottom MD yarns, respectively. The stacked, contiguous woven machine direction system provides stability and permits the MD yarns to have a relatively high aspect ratio, cross-sectional width to height, of greater than 3:1.

27 Claims, 2 Drawing Sheets

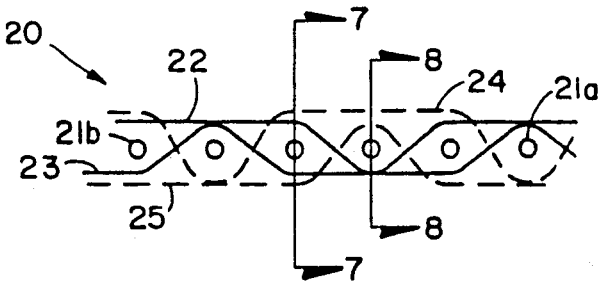
FIG. 6
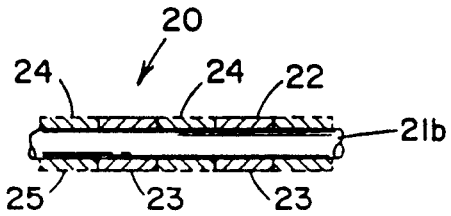
FIG. 7
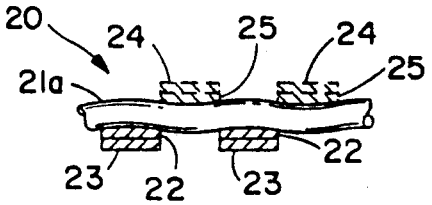
FIG. 8
FIG. 9
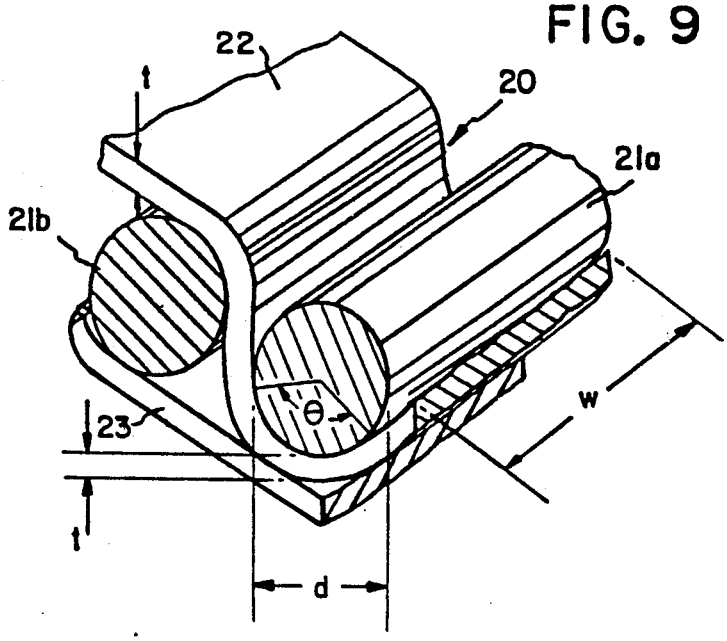

PAPERMAKERS FABRIC WITH FLAT HIGH ASPECT RATIO YARNS

This application is a continuation-in-part of my copending application Ser. No. 07/534,164 entitled PAPERMAKERS FABRIC WITH STACKED MACHINE DIRECTION YARNS, filed Jun. 6, 1990, which application is incorporated by reference herein as if fully set forth.

The present invention relates to papermakers fabrics and in particular to fabrics comprised of flat monofilament yarns having a high aspect ratio of cross-sectional width to height.

BACKGROUND OF THE INVENTION

Papermaking machines generally are comprised of three sections: forming, pressing, and drying. Papermakers fabrics are employed to transport a continuous paper sheet through the papermaking equipment as the paper is being manufactured. The requirements and desirable characteristics of papermakers fabrics vary in accordance with the particular section of the machine where the respective fabrics are utilized.

With the development of synthetic yarns, shaped monofilament yarns have been employed in the construction of papermakers fabrics. For example, U.S. Pat. No. 4,290,209 discloses a fabric woven of flat monofilament warp yarns; U.S. Pat. No. 4,755,420 discloses a non-woven construction where the papermakers fabric is comprised of spirals made from flat monofilament yarns.

Numerous weaves are known in the art which are employed to achieve different results. For example, U.S. Pat. No. 4,438,788 discloses a dryer fabric having three layers of cross machine direction yarns interwoven with a system of flat monofilament machine direction yarns such that floats are created on both the top and bottom surfaces of the fabric. The floats tend to provide a smooth surface for the fabric.

Permeability is an important criteria in the design of papermakers fabrics. In particular, with respect to fabrics made for running at high speeds on modern drying equipment, it is desirable to provide dryer fabrics with relatively low permeability.

U.S. Pat. No. 4,290,209 discloses the use of flat monofilament warp yarns woven contiguous with each other to provide a fabric with reduced permeability. However, even where flat warp yarns are woven contiguous with each other, additional means, such as stuffer yarns, are required to reduce the permeability of the fabric. As pointed out in that patent, it is desirable to avoid the use of fluffy, bulky stuffer yarns to reduce permeability which make the fabric susceptible to picking up foreign substances or retaining water.

U.S. Pat. No. 4,290,209 and U.S. Pat. No. 4,755,420 note practical limitations in the aspect ratio (cross-sectional width to height ratio) of machine direction warp yarns defining the structural weave of a fabric. The highest practical aspect ratio disclosed in those patents is 3:1, and the aspect ratio is preferably, less than 2:1.

U.S. Pat. No. 4,621,663, assigned to the assignee of the present invention, discloses one attempt to utilize high aspect ratio yarns (on the order of 5:1 and above) to define the surface of a papermakers dryer fabric. As disclosed in that patent, a woven base fabric is provided to support the high aspect ratio surface yarns. The woven base fabric is comprised of conventional round yarns and provides structural support and stability to the fabric disclosed in that patent.

U.S. Pat. No. 4,815,499 discloses the use of flat yarns in the context of a forming fabric. That patent discloses a composite fabric comprised of an upper fabric and a lower fabric tied together by binder yarns. The aspect ratio employed for the flat machine direction yarns in both the upper and lower fabrics are well under 3:1.

SUMMARY AND OBJECTS INVENTION

The present invention is directed to a papermakers fabric which provides for usage of high aspect ratio yarns as structural weave components. The fabric comprises a system of flat monofilament machine direction yarns (hereinafter MD yarns) which are woven in a selected weave construction which provides stability to the fabric.

In a preferred embodiment, the system of MD yarns comprises upper and lower yarns which are vertically stacked. Preferably, the upper MD yarns define floats on the upper surface of the fabric and each upper MD yarn is paired in a vertically stacked orientation with a lower MD yarn. The lower MD yarns may weave in an inverted image of the upper MD yarns to provide floats on the bottom fabric surface or may weave with a different repeat to provide a different surface on the bottom of the fabric.

At least the upper MD yarns are flat monofilament yarns woven contiguous with each other to reduce the permeability of the fabric and to lock in the machine direction alignment of the stacking pairs of MD yarns. In the preferred embodiment, the same type and size yarns are used throughout the machine direction yarn system and both the top and the bottom MD yarns weave contiguously with adjacent top and bottom MD yarns, respectively. The stacked, contiguous woven machine direction system provides stability and permits the MD yarns to have a relatively high aspect ratio, cross-sectional width to height, of greater than 3:1; the aspect ratio preferably ranging from about 2:1 to 6:1.

It is an object of the invention to provide a papermakers fabric which utilizes high aspect yarns as structural weave components.

Other objects and advantages will become apparent from the following description of presently preferred embodiments.

BRIEF DESCRIPTION OF DRAWINGS

FIG. 6 is a schematic view of a second embodiment of a fabric made in accordance with the present invention;

FIG. 7 is a cross-sectional view of the fabric depicted in FIG. 6 along line 7—7;

FIG. 8 is a cross-sectional view of the fabric depicted in FIG. 6 along line 8—8; and FIG. 9 is a perspective view of a portion of the fabric illustrated in FIGS. 6–8.

DETAILED DESCRIPTION OF PRESENTLY PREFERRED EMBODIMENTS

Figure 1:
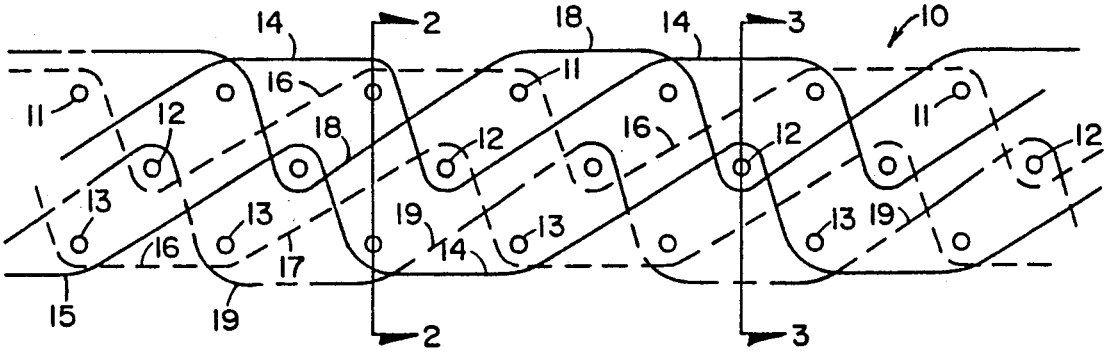
FIG. 1 is a schematic diagram of a papermakers fabric made in accordance with the teachings of the present invention.
Figure 2:
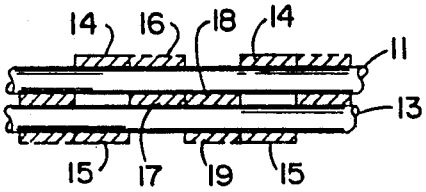
FIG. 2 is a cross-sectional view of the fabric depicted in FIG. 1 along line 2—2.
Figure 3:
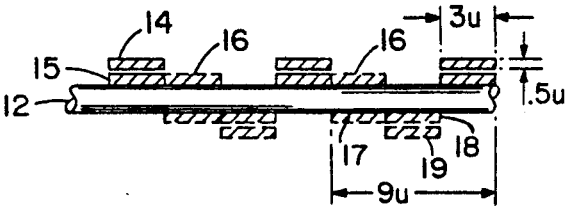
FIG. 3 is a cross-sectional view of the fabric depicted in FIG. 1 along line 3—3.

Referring to FIGS. 1, 2, and 3, there is shown a papermakers dryer fabric 10 comprising upper, middle and lower layers of cross machine direction (hereinafter CMD) yarns 11, 12, 13, respectively, interwoven with a system of MD yarns 14–19 which sequentially weave in a selected repeat pattern. The MD yarn system comprises upper MD yarns 14, 16, 18 which interweave with CMD yarns 11, 12 and lower MD yarns 15, 17, 19 which interweave with CMD yarns 12, 13.

The upper MD yarns 14, 16, 18 define floats on the top surface of the fabric 10 by weaving over two upper layer CMD yarns 11 dropping into the fabric to weave in an interior knuckle under one middle layer CMD yarn 12 and under one CMD yarn 11 and thereafter rising to the surface of the fabric to continue the repeat of the yarn. The floats over upper layer CMD yarns 11 of upper MD yarns 14, 16, 18 are staggered so that all of the upper and middle layer CMD yarns 11, 12 are maintained in the weave.

As will be recognized by those skilled in the art, the disclosed weave pattern with respect to FIGS. 1, 2, and 3, results in the top surface of the fabric having a twill pattern. Although the two-float twill pattern represented in FIGS. 1, 2, and 3 is a preferred embodiment, it will be recognized by those of ordinary skill in the art that the length of the float, the number of MD yarns in the repeat, and the ordering of the MD yarns may be selected as desired so that other patterns, twill or non-twill, are produced.

As best seen in FIGS. 2 and 3, lower MD yarns 15, 17, 19, weave directly beneath upper MD yarns 14, 16, 18, respectively, in a vertically stacked relationship. The lower yarns weave in an inverted image of their respective upper yarns. Each lower MD yarn 15, 17, 19 floats under two lower layer CMD yarns 13, rises into the fabric over one CMD yarn 13 and forms a knuckle around one middle layer CMD yarn 12 whereafter the yarn returns to the lower fabric surface to continue its repeat floating under the next two lower layer CMD yarns 13.

With respect to each pair of stacked yarns, the interior knuckle, formed around the middle layer CMD yarns 12 by one MD yarn, is hidden by the float of the other MD yarn. For example, in FIGS. 1 and 3, lower MD yarn 15 is depicted weaving a knuckle over CMD yarn 12 while MD yarn 14 is weaving its float over CMD yarns 11, thereby hiding the interior knuckle of lower MD yarn 15. Likewise, with respect to FIGS. 1 and 3, upper MD yarn 18 is depicted weaving a knuckle under yarn CMD yarn 12 while it is hidden by lower MD yarn 19 as it floats under CMD yarns 13.

The upper MD yarns 14, 16, 18, are woven contiguous with respect to each other. This maintains their respective parallel machine direction alignment and reduces permeability. Such close weaving of machine direction yarns is known in the art as 100% warp fill as explained in U.S. Pat. No. 4,290,209. As taught therein (and used herein), actual warp count in a woven fabric may vary between about 80%–125% in a single layer and still be considered 100% warp fill.

The crowding of MD yarns 14, 16, and 18 also serves to force MD yarns 15, 17, 19, into their stacked position beneath respective MD yarns 14, 16, 18. Preferably MD yarns 15, 17, and 19 are the same size as MD yarns 14, 16, and 18 so that they are likewise woven 100% warp fill. This results in the overall fabric of the preferred embodiment having 200% warp fill of MD yarns.

Since the lower MD yarns 15, 17, 19 are also preferably woven 100% warp fill, they likewise have the effect of maintaining the upper MD yarns 14, 16, 18 in stacked relationship with the respect to lower MD yarns 15, 17, 19. Accordingly, the respective MD yarn pairs 14 and 15, 16 and 17, 18 and 19 are doubly locked into position thereby enhancing the stability of the fabric.

As set forth in the U.S. Pat. No. 4,290,209, it has been recognized that machine direction flat yarns will weave in closer contact around cross machine direction yarns than round yarns. However, a 3:1 aspect ratio was viewed as a practical limit for such woven yarns in order to preserve overall fabric stability. The present stacked MD yarn system preserves the stability and machine direction strength of the fabric and enables the usage of yarns with increased aspect ratio, in a preferred range of 2:1 to 6:1, to more effectively control permeability.

The high aspect ratio of the MD yarns translates into reduced permeability. High aspect ratio yarns are wider and thinner than conventional flat yarns which have aspect ratios less than 3:1 and the same cross-sectional area. Equal cross-sectional area means that comparable yarns have substantially the same linear strength. The greater width of the high aspect ratio yarns translates into fewer interstices over the width of the fabric than with conventional yarns so that fewer openings exist in the fabric through which fluids may flow. The relative thinness of the high aspect ratio yarns enables the flat MD yarns to more efficiently cradle, i.e. brace, the cross machine direction yarns.

Figure 4:
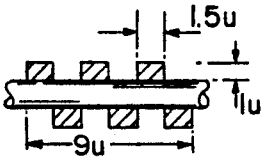
FIG. 4 PRIOR ART
FIG. 4 is a cross-sectional view of a prior art weave construction.

For example, as illustrated in FIG. 4, a fabric woven with a single layer system of a flat machine direction warp having a cross-sectional width of 1.5 units and a cross-sectional height of 1 unit, i.e. an aspect ratio of 1.5:1, is shown. Such fabric could be replaced by a fabric having the present dual stacked MD yarn system with MD yarns which are twice the width, i.e. 3 units, and half the height, i.e. 0.5 units. Such MD yarns thusly having a fourfold greater aspect ratio of 6:1, as illustrated in FIG. 3.

The thinner, wider MD yarns more efficiently control permeability while the machine direction strength of the fabric remains essentially unaltered since the cross-sectional area of the MD yarns over the width of the fabric remains the same. For the above example, illustrated by FIGS. 4 and 3, the conventional single MD yarn system fabric has six conventional contiguous flat yarns over 9 units of the fabric width having a cross-sectional area of 9 square units, i.e. 6*(1u.*1.5u.). The thinner, wider high aspect ratio yarns, woven as contiguous stacked MD yarns, define a fabric which has three stacked pairs of MD yarns over 9 units of fabric width. Thus such fabric also has a cross-sectional area of 9 square units, i.e. (3*(0.5u.*3u.))+(3*(0.5u.*3u.)). over 9 units of fabric width.

In one example, a fabric was woven in accordance with FIGS. 1, 2 and 3, wherein the CMD yarns 11, 12, 13 were polyester monofilament yarns 0.6 mm in diameter interwoven with MD yarns 14–19 which were flat polyester monofilament yarns having a width of 1.12 mm and a height of 0.2 mm. Accordingly, the aspect ratio of the flat MD yarns was 5.6:1. The fabric was woven at 48 warp ends per inch with a loom tension of 40 PLI (pounds per linear inch) and 12.5 CMD pick yarns per inch per layer (three layers).

The fabric was heat set in a conventional heat setting apparatus under conditions of temperature, tension and time within known ranges for polyester monofilament yarns. For example, conventional polyester fabrics are heat set within parameters of 340° F.-380° F. temperature, 6-15 PLI (pounds per linear inch) tension, and 3-4 minutes time. However, due to their stable structure, the fabrics of the present invention are more tolerant to variations in heat setting parameters.

The fabric exhibited a warp modulus of 6,000 PSI (pounds per square inch) measured by the ASTM D-1682-64 standard of the American Society for Testing and Materials. The fabric stretched less that 0.2% in length during heat setting. This result renders the manufacture of fabrics in accordance with the teachings of the present invention very reliable in achieving desired dimensional characteristic as compared to conventional fabrics.

The resultant heat set fabric had 12.5 CMD yarns per inch per layer with 106% MD warp fill with respect to both upper and lower MD yarns resulting in 212% actual warp fill for the fabric. The finished fabric has a permeability of 83CFM (cubic feet per minute) as measured by the ASTM D-737-75 standard.

Figure 5:
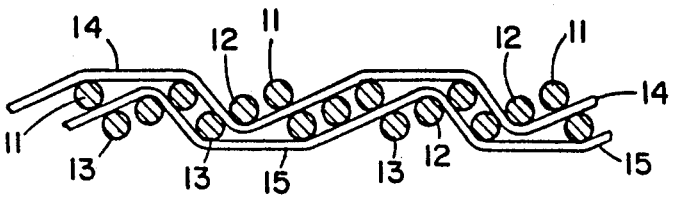
FIG. 5 illustrates the actual yarn structure of the fabric depicted in FIG. 1 in the finished fabric showing only two representative stacked MD yarns.

As illustrated in FIG. 5, when the fabric 10 is woven the three layers of CMD yarns 11, 12, 13 become compressed. This compression along with the relatively thin dimension of the MD yarns reduces the caliper of the fabric. Accordingly, the overall caliper of the fabric can be maintained relatively low and not significantly greater than conventional fabrics woven without stacked MD yarn pairs. In the above example, the caliper of the finished fabric was 0.050 inches.

It will be recognized by those of ordinary skill in the art that if either top MD yarns 14, 16, 18 or bottom MD yarns 15, 17, 19 are woven at 100% warp fill, the overall warp fill for the stacked fabric will be significantly greater than 100% which will contribute to the reduction of permeability of the fabric. The instant fabric having stacked MD yarns will be recognized as having a significantly greater percentage of a warp fill than fabrics which have an actual warp fill of 125% of non-stacked MD yarns brought about by crowding and lateral undulation of the warp strands. Although the 200% warp fill is preferred, a fabric may be woven having 100% fill for either the upper or lower MD yarns with a lesser degree of fill for the other MD yarns by utilizing yarns which are not as wide as those MD yarns woven at 100% warp fill. For example, upper yarns 14, 16, 18 could be 1 unit wide with lower layer yarns 15, 17, 19 being 0.75 units wide which would result in a fabric having approximately 175% warp fill.

Such variations can be used to achieve a selected degree of permeability. Alternatively, such variations could be employed to make a forming fabric. In such a case, the lower MD yarns would be woven 100% warp fill to define the machine side of the fabric and the upper MD yarns would be woven at a substantially lower percentage of fill to provide a more open paper forming surface.

Referring to FIGS. 6, 7 and 8, there is shown a second preferred embodiment of a fabric 20 made in accordance with the teachings of the present invention. Papermakers fabric 20 is comprised of a single layer of CMD yarns 21*a*, 21*b* interwoven with a system of stacked MD yarns 22-25 which weave in a selected repeat pattern. The MD yarn system comprises upper MD yarns 22, 24 which define floats on the top surface of the fabric 20 by weaving over three CMD yarns, under the next one CMD yarn 21*a* to form a knuckle, and thereafter returning to float over the next three CMD yarns in a continuation of the repeat.

Lower MD yarns 23, 25, weave directly beneath respective upper MD yarns 22, 24 in a vertically stacked relationship. The lower MD yarns weave in an inverted image of their respective upper MD yarns. Each lower MD yarn 23, 25 floats under three CMD yarns, weaves upwardly around the next one CMD yarn 21*a* forming a knuckle and thereafter continues in the repeat to float under the next three CMD yarns.

As can be seen with respect to FIGS. 6 and 8, the knuckles formed by the lower MD yarns 23, 25 are hidden by the floats defined by the upper MD yarns 22, 24 respectively. Likewise the knuckles formed by the upper MD yarns 22, 24 are hidden by the floats of the lower MD yarns 23, 25 respectively.

The caliper of the fabric proximate the knuckle area shown in FIG. 8, has a tendency to be somewhat greater than the caliper of the fabric at non-knuckle CMD yarns 21*b*, shown in FIG. 7. However, the CMD yarns 21*a* around which the knuckles are formed become crimped which reduces the caliper of the fabric in that area as illustrated in FIG. 8. Additionally, slightly larger diameter CMD yarns are preferably used for CMD yarns 21*b*, shown in FIG. 7, which are not woven around as knuckles by the MD yarns to eliminate any difference in fabric caliber. Preferably the diameter of the larger CMD yarn 21*b* equals the diameter d of the smaller CMD yarns 21*a* plus the thickness t of the MD yarns.

In one example, a fabric was woven in accordance with FIGS. 6-9, wherein the CMD yarns 21*a*, 21*b* were polyester monofilament yarns 0.6 mm and 0.8 mm, respectively, in diameter interwoven with MD yarns 22-25 which were flat polyester monofilament yarns having a width of 1.12 mm and a height of 0.2 mm. Accordingly, the aspect ratio of the flat MD yarns was 5.6:1. The fabric was woven at 48 total warp ends per inch with a loom tension of 40 PLI (pounds per linear inch) and 20 CMD total pick yarns per inch. The permeability averaged 90 CFM in the resultant fabric.

As best shown in FIG. 9, the high aspect ratio yarns 22-24 effectively brace the CMD yarns 21*a* in the weave construction. This bracing effect can be quantified in terms of the degree of contact arc Θ and contact bracing area, CBA, as follows:

$$CBA = \pi d \left( \frac{\Theta}{360^\circ} \right) w$$

where d = diameter of the CMD yarn

Θ = the degree of arc over which there is contact between the MD and CMD yarns w = width of the MD yarn $\pi$ = the constant pi.

The degrees of arc over which MD yarns 22-25 are in contact with CMD yarns 21*a* is dependent upon the spacing of the CMD yarns within the weave. For the above example, employing alternating 0.6 mm and 0.8 mm diameter CMD yarns with 0.2 mm thick MD yarns, the degree of contact arc can be maintained in a preferred range of between 60° to 180° by varying the pick count of the CMD yarns from 14 picks per inch to a maximum of 28.22 picks per inch.

In the preferred embodiment where the pick count is 20 picks per inch, the degree of contact arc Θ is approximately 101°. This results in a bracing contact area of approximately 0.79 $mm^2$ at each knuckle in the fabric.

Applicant's use of high ratio aspect yarns, i.e. yarns having a width:thickness ratio of at least 3:1, provides for increased bracing contact of the flat MD yarns with the CMD yarns 21*a*. This is comparatively exemplified by modifying the equation for contact bracing area, CBA, to be defined in terms of the thickness of the MD yarns.

Since the MD yarn width w equals the thickness t of the MD yarn multiplied by the aspect ratio, $w > 3t$ for yarns having an aspect ratio greater than 3:1. Accordingly, fabrics made in accordance with the teachings of the present invention utilizing high aspect ratio MD yarns exhibit enhanced bracing of the CMD yarns by the MD yarns such that:

$$CBA > \pi d \left( \frac{\Theta}{360^\circ} \right) 3t.$$

The preferred inverted image weave of the lower MD yarns facilitates the creation of seaming loops at the end of the fabric which enable the fabric ends to be joined together. In forming a seaming loop, the upper MD yarns extend beyond the end of the fabric and the respective lower yarns are trimmed back a selected distance from the fabric end. The upper MD yarns are then bent back upon themselves and rewoven into the space vacated by the trimmed lower MD yarns. When the upper MD yarns are backwoven into the space previously occupied by the lower MD yarns, their crimp matches the pattern of the lower MD yarns, thereby locking the resultant end loops in position. Similarly, alternate top MD yarns can be backwoven tightly against the end of the fabric such that loops formed on the opposite end of the fabric can be intermeshed in the spaces provided by the non-loop forming MD yarns to seam the fabric via insertion of a pintle through the intermeshed end loops.

Since the top and bottom machine direction yarns are stacked, the resultant end loops are orthogonal to the plane of the fabric surface and do not have any twist. In conventional backweaving techniques, the loop defining yarns are normally backwoven into the fabric in a space adjacent to the yarn itself. Such conventional loop formation inherently imparts a twist to the seaming loop, see U.S. Pat. No. 4,438,788, FIG. 6.

A variety of other weave patterns employing the paired stacked weave construction of the instant invention may be constructed within the scope of the present invention. For example, in some applications it may be desirable to have MD yarn surface floats over four or more CMD yarns. Such fabrics are readily constructed in accordance with the teachings of the present invention.

I claim:

1. A papermakers fabric comprising:

a system of flat MD (machine direction) yarns having a thickness t interwoven with a system of CMD (cross machine direction) yarns;

said MD yarns woven with selected CMD yarns having a diameter d in bracing contact over a contact arc of Θ degrees such that the contact bracing area CBA of the MD yarn interweaving with said selected CMD yarns is related to the degree of contact arc Θ as follows:

$$CBA > \pi d \left( \frac{\theta}{360^\circ} \right) 3t$$

where d = diameter of the CMD yarns

Θ = the degree of arc over which there is contact between the MD and CMD yarns t = thickness of the CMD yarns $\pi$ = the constant pi.

2. A papermakers fabric according to claim 1 wherein Θ is at least 60° and t is about 0.2 mm.

3. A papermakers fabric according to claim 1 wherein said fabric consists essentially of all monofilament yarns.

4. A papermakers fabric according to claim 1 wherein Θ is about 101°.

5. A papermakers fabric according to claim 1 wherein the average permeability over the fabric is 90 CFM (cubic feet per minute).

6. A papermakers fabric according to claim 5 wherein the range of permeability is 87–93 CFM (cubic feed per minute).

7. A papermakers fabric according to claim 1 wherein the CMD yarn system is a single layer of CMD yarns.

8. A papermakers fabric according to claim 7 wherein said MD yarns interweave with knuckles only with alternate CMD yarns of said single CMD yarn layer, said alternate CMD yarns being said selected CMD yarns.

9. A papermakers fabric according to claim 8 wherein the diameter of the alternate non-selected CMD yarns is about t + d.

10. A papermakers fabric according to claim 8 wherein t is about 0.2 mm, d is about 0.6 mm, the diameter of the alternate non-selected CMD yarns is about 0.8 mm and Θ is about 101°.

11. A papermakers fabric according to claim 10 wherein the average permeability over the fabric is 90 CFM.

12. A papermakers fabric according to claim 11 wherein the range of permeability is 87–93 CFM.

13. A papermakers fabric comprising a system of CMD (cross-machine direction) yarns interwoven with a system of flat monofilament MD (machine direction) yarns as structural weave components in a selected repeat pattern; said MD yarns consisting essentially of yarns having an aspect ratio greater than 3:1.

14. A papermakers fabric according to claim 13 wherein said MD yarns comprise pairs of upper and lower MD yarns stacked in vertical alignment and at least said upper MD yarns are 100% warp fill.

15. A papermakers fabric according to claim 13 wherein said CMD yarn system further includes an upper, middle and lower layer of CMD yarns and wherein said MD yarns interweave with said middle layer CMD yarns with hidden interior knuckles said upper MD yarns interweaving with said upper and middle layer CMD yarns, and said lower MD yarns interweaving with said lower and middle layer CMD yarns.

16. A papermakers fabric according to claim 13 wherein said fabric consists essentially of all monofilament yarns.

17. A papermakers fabric according to claim 13 wherein said CMD yarn system comprises a single layer of CMD yarns and wherein said MD yarns interweave with said single layer of CMD yarns with hidden interior knuckles.

18. A papermakers fabric comprising a system of CMD (cross-machine direction) yarns interwoven with a system of flat monofilament MD (machine direction) yarns in a selected repeat pattern wherein said MD yarns comprise pairs of upper and lower MD yarns stacked in vertical alignment; and wherein at least said upper MD yarns have an aspect ratio greater than 3:1.

19. A papermakers fabric comprising:

a single layer system of CMD (cross-machine direction) yarns having yarns of at least two different diameters;

a system of MD (machine direction) yarns interwoven with said CMD yarns in a selected repeat pattern such that the CMD yarns having the relatively smaller diameter are crimped significantly more than the CMD yarns having the relatively larger diameter.

20. A papermakers fabric according to claim 19 wherein said:

MD yarns are flat monofilament yarns having paired upper and lower yarns stacked in vertical alignment; and at least said upper MD yarns are 100% warp fill.

21. A papermakers fabric according to claim 19 wherein CMD yarns alternate between a first relatively larger diameter and a second relatively smaller diameter in said single CMD layer.

22. A papermakers fabric according to claim 21 wherein said MD yarns are flat monofilament yarns having a thickness t and said first diameter is approximately equal to said second diameter plus t.

23. A papermakers fabric according to claim 21 wherein said first diameter is about 0.8 mm, said second diameter is about 0.6 mm, and said MD yarns are flat monofilament yarns having a thickness of about 0.2 mm.

24. A papermakers fabric comprising a single layer of CMD (cross-machine direction) yarns interwoven with a system of MD (machine direction) yarns such that alternate CMD yarn are crimped to a significantly greater degree than the respective adjacent CMD yarns in said single CMD layer.

25. A papermakers fabric according to claim 24 wherein said CMD yarns are flat monofilament yarns having an aspect ratio greater than 3:1.

26. A papermakers fabric according to claim 13 wherein said MD yarns comprise pairs of upper and lower MD yarns stacked in vertical alignment.

27. A papermakers fabric according to claim 18 wherein at least said upper MD yarns are 100% warp fill.

* * * * *

UNITED STATES PATENT AND TRADEMARK OFFICE

CERTIFICATE OF CORRECTION

PATENT NO. : 5,117,865

DATED : June 2, 1992

INVENTOR(S) : Henry J. Lee

It is certified that error appears in the above-identified patent and that said Letters Patent is hereby corrected as shown below:

On title page, item [56] insert

--4,123,022 10/1978 Dutt et al. .....245/10

4,865,083 9/1989 Cunnane.....139/383

FOREIGN PATENT DOCUMENTS 144592 6/1985 European Pat. Off.--

Item [57]

At line 3 of the abstract, delete "structured" and insert therefor --structural--.

At column 2, line 10, after 'OBJECTS' insert --OF THE--.

UNITED STATES PATENT AND TRADEMARK OFFICE
CERTIFICATE OF CORRECTION

PATENT NO. : 5,117,865

DATED : June 2, 1992

INVENTOR(S) : Henry J. Lee

It is certified that error appears in the above-identified patent and that said Letters Patent is hereby corrected as shown below:

IN THE DRAWINGS

In the drawings, bottom center of Figure 1, delete reference numeral "14".

IN THE CLAIMS

In claim 6, column 8, line 26, delete "feed" and insert therefor --feet--.

In claim 15, column 8, line 61, after 'knuckles' insert -- ; --.

In claim 24, column 10, line 16, delete "yarn" and insert therefor --yarns--.

Signed and Sealed this

Sixteenth Day of November, 1993

Bruce Lehman

*Attest:*

BRUCE LEHMAN

*Attesting Officer*

*Commissioner of Patents and Trademarks*